United States Patent [19]

Piro

[11] 3,935,629

[45] Feb. 3, 1976

[54] PIN INSERTION MACHINE FOR NEEDLE SELECTING CYLINDERS OF CIRCULAR KNITTING MACHINES

[75] Inventor: Mario Piro, Genoa-Pegli, Italy

[73] Assignee: Nuova San Giorgio S.p.A., Italy

[22] Filed: July 30, 1974

[21] Appl. No.: 493,143

[30] Foreign Application Priority Data

Aug. 9, 1973 Italy ..... 27713/73

[52] U.S. Cl. ..... 29/208 C; 29/208 R; 29/211 R

[51] Int. Cl.[2] ..... B23P 19/04

[58] Field of Search ..... 29/208 C, 208 R, 211 R, 29/200 R, 211 C

[56] References Cited

UNITED STATES PATENTS

| | | | |
|---|---|---|---|
| 2,392,776 | 1/1946 | Schultze | 29/208 X |
| 2,940,165 | 6/1960 | Lucke | 29/211 R |
| 3,017,690 | 1/1962 | Kalish | 29/211 R X |
| 3,747,191 | 7/1973 | Kuhn et al. | 29/208 C |

*Primary Examiner*—Victor A. DiPalma

[57] ABSTRACT

A machine for inserting pins or pegs in the holes of needle selecting cylinders for circular knitting machines. According to the disclosure, the machine comprises a cylinder spindle and a side support movable longitudinally of the spindle, having placed thereon a device for inserting the pins in the holes of said cylinder; said device being controlled to sequentially operate by signals provided by a device for directly reading the pattern; a pin feeding means having a gravity storage means provides for feeding the pins in aligned relationship in front of a pusher member of said inserting device.

9 Claims, 8 Drawing Figures

PIN INSERTION MACHINE FOR NEEDLE SELECTING CYLINDERS OF CIRCULAR KNITTING MACHINES

This invention relates to a machine particularly designed for automatic insertion of pins or pegs in jacquard or needle selecting cylinders of circular knitting machines, according to a suitable sequence and corresponding to the pattern to be reproduced.

There are commercially available machines for pin insertion in the needle selecting cylinders of circular knitting machines, such machines being provided with a semi-automatic operation, or involving the use of manual controls by an operator; particularly, in such known machines, the pattern to be reproduced is line by line scanned and the data being obtained are carried over on cards which are successively supplied to the machine operator. On reading such cards, the operator will tap the keys on a keyboard for controlling the insertion or not of the pins in a cylinder. Thus, such machines involve highly long times, as well as considerable errors due both to a misinterpretation of the pattern, wrong reading of the cards and wrong operation of the machine, which errors, by superimposing to one another, will involve in turn further shortcomings at the weaving step, because of the long and difficult investigations for the error existing in one or more of the needle selecting cylinders such circular knitting machines are fitted with.

It is the object of the present invention to provide a machine which, as controlled by an electronic device for "reading" the pattern to be reproduced, the device being the subject of applicant's Pat. application Ser. No. 432,584, now U.S. Pat. No. 3,868,650 filed Jan. 11, 1974, will automatically carry out the operations concerning pin loading and insertion or introduction into a needle selecting cylinder, in accordance with the control sequences provided by said electronic pattern reading device.

Therefore, by a machine according to the invention the times required for setting up the needle selecting cylinders are reduced to a very high extent, and any human error is completely avoided as well.

Generally, according to the invention, a machine for pin insertion in needle selecting cylinders of circular knitting machines, said machine being automatically sequentially controlled by an electronic device for reading the pattern to be reproduced, the outer surface of said cylinder having holes therein for inserting the pins aligned according to longitudinal rows and evenly angularly spaced apart from one another, comprising a cylinder spindle, a side bearing movable longitudinally of and relatively to said spindle, said bearing having attached thereto a device for pin insertion in the cylinder holes, sequentially controlled by the signals supplied by said electronic pattern reading device, and a pin feeding device connected to a pin storage means for said insertion device providing for parallelling the supplied pins.

Particularly, the cylinder spindle is horizontally located at work position and is vertically or upwardly overturnable both for enabling the introduction and removal of a cylinder without any casual exiting of the pins from the associated holes.

In accordance with further features of the machine according to the invention, in order to ensure accurate feedings of the pin inserting device, such feedings being the same as the pitch or spacing between two adjoining holes in a same row, mechanical Geneva wheel control devices are used, which devices are of simple construction and reliable in operation. However, other mechanical or electrical type of devices suitably intended for the purpose can be used in place of such control devices.

A particular structural example of the machine according to the invention will now be described with reference to the accompanying drawings, in which.

Figure 1:
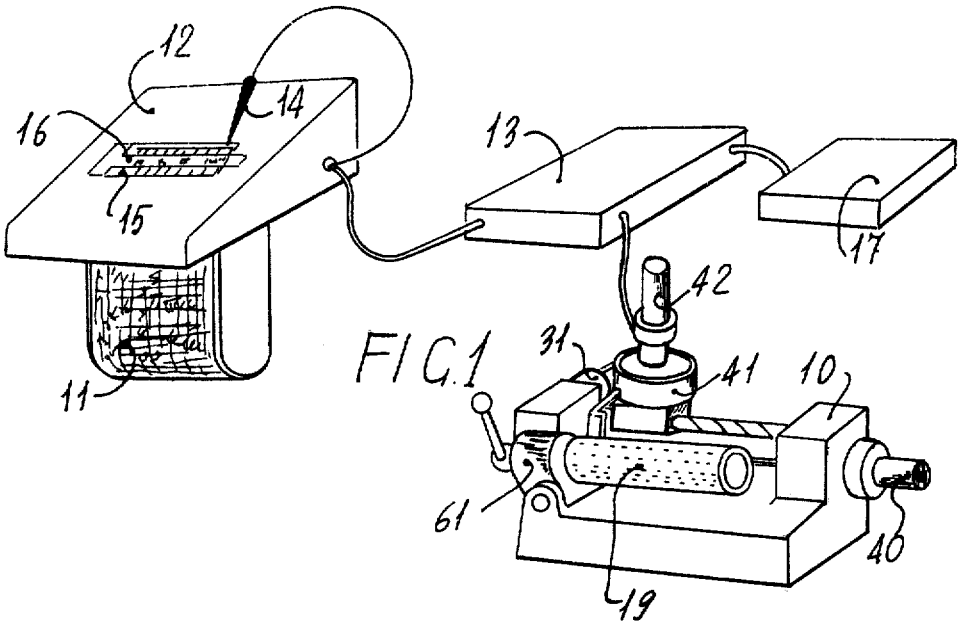
FIG. 1 is an overall perspective view of the machine according to the invention and the electronic pattern reading device associated therewith.

Referring to the drawings, and particularly to FIG. 1, the machine 10 is controlled to automatically accomplish a predetermined operation sequence, through the reading of a pattern 11 to be reproduced by an electronic pattern reading device 12, forming the subject of an earlier patent application in U.S.A. Ser. No. 432,584 filed on Jan. 11, 1974 of the same applicant, and connected to a logic circuit 13 controlling the machine 10. Briefly, through a push rod 14 on the device 12, those contacts 15 at the marks set on the pattern 11 and visible through a slit 16 in the device 12 are contacted.

The signals thus generated are processed by said logic circuit 13 and then supplied to the machine 10 for sequentially controlling the supply and insertion operations of the pins in a jacquard or needle selecting cylinder of a circular knitting machine and suitably set on said machine 10. A magnetic tape memory 17 can be connected to said logic 13 for a pattern data storage.

Figure 2:
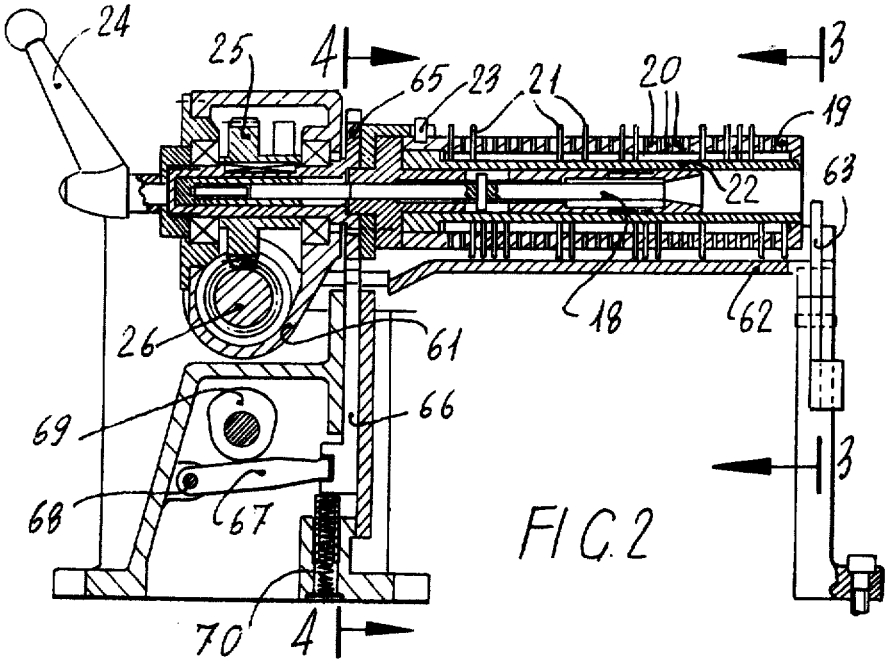
FIG. 2 is a longitudinal sectional view of the machine at the cylinder spindle, or taken along line 2—2 of FIG. 5.
Figure 3:
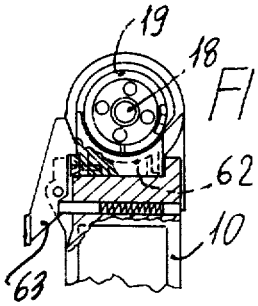
FIG. 3 is a cross-section taken along line 3—3 of FIG. 2.

More particularly describing the machine according to the present invention, it will be seen that the machine 10 includes a structure carrying a rotating spindle 18 (FIGS. 2–5), at its horizontal work position shown in FIG. 2 carrying and rotatably driving a cylinder 19 provided along longitudinal rows equiangularly spaced apart with holes 20 for inserting the needle selecting pins according to cycles provided by the above mentioned electronic pattern reading device 12.

The pins 21, as loosely inserted in the holes 20 of said cylinder 19, are stopped and correctly positioned by an inner bush 22, at one end the cylinder 19 also having a positioning pin 23 projecting from the side face thereof.

The spindle 18 carries expansion pliers for locking and rotatably driving the cylinder 19, such pliers being manually operable by the handle 24 shown in FIG. 2.

Figure 8:
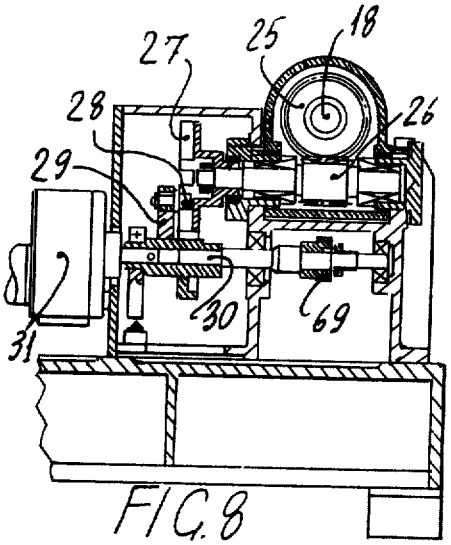
FIG. 8 is a cross-section taken along line 8—8 of FIG. 7.

The spindle 18 is rotably carried about its axis by suitable bearings and is connected to a helical gear 25 meshing on the worm screw 26 (FIGS. 2 and 8) arranged transversally of the machine.

A Geneva wheel 27 is keyed to one end of the shaft of said worm screw 26 and capable of engaging with a pin 28, carried sidewise projecting by a lever 29 made fast with a control shaft 30. This shaft 30 is mechanically connected to a control geared motor 31, so that at every complete revolution of the control shaft 30, said pin 28 of lever 29 causes rotation through one-fourth of revolution for said Geneva wheel 27 and said worm screw 26 as well. The ratio of the helical gears 25 to the worm screw 26 is suitably selected and such that at every rotation through one-fourth of revolution for the Geneva wheel 27, there will correspond a fraction of angular rotation for cylinder 19 equal to the spacing between two adjoining rows of holes.

Figure 6:
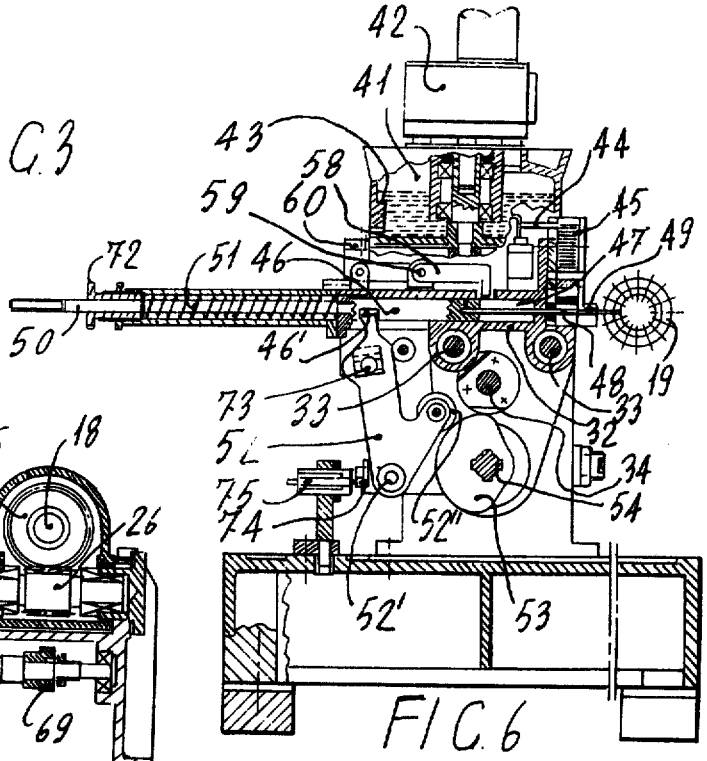
FIG. 6 is a cross-section substantially taken along line 6—6 of FIG. 5.
Figure 7:
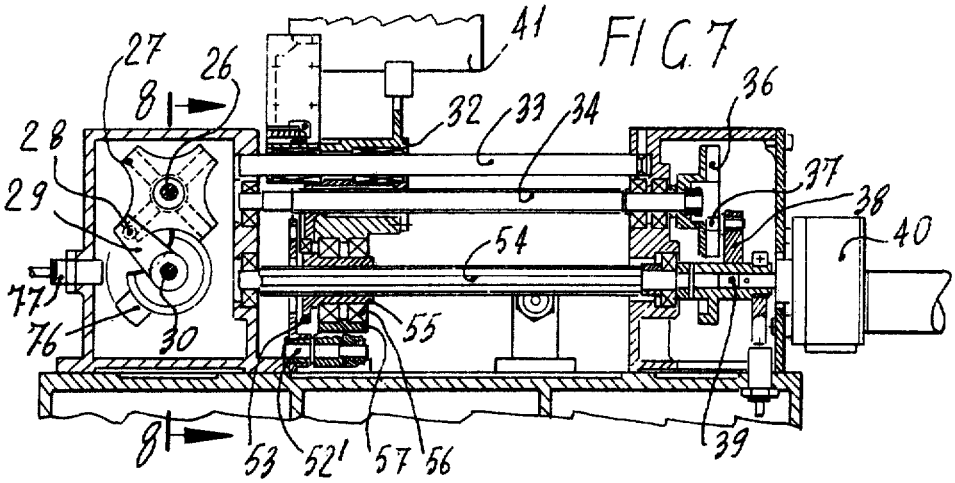
FIG. 7 is a longitudinal sectional view on a vertical plane taken along line 7—7 of FIG. 5.
Figure 5:
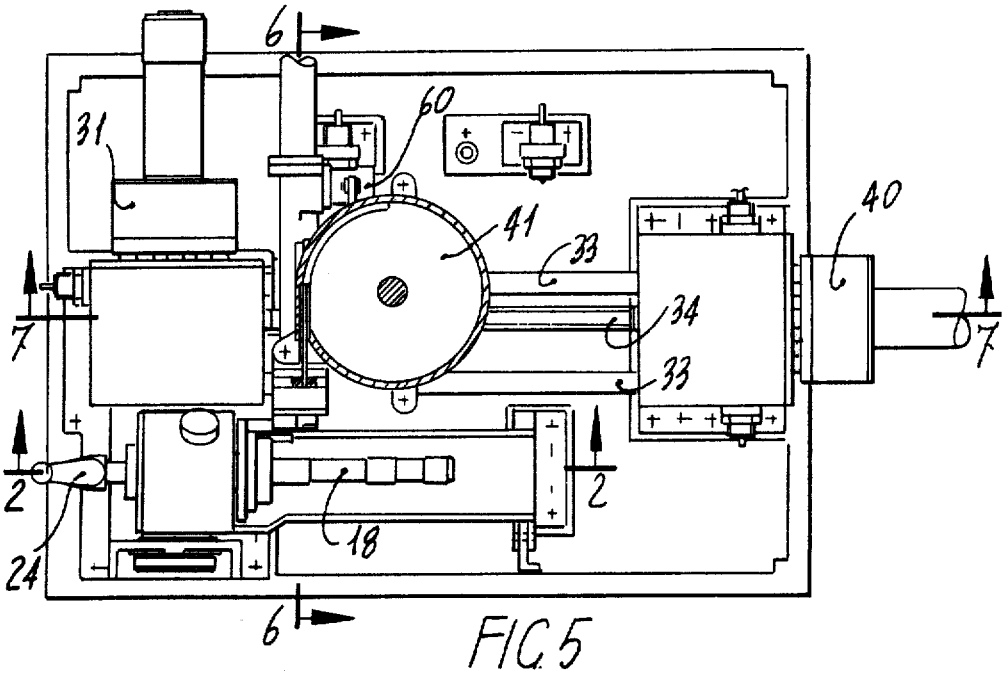
FIG. 5 is a top plan, partly sectional view of the machine shown in FIG. 1, the cylinder wherein the pins are to be inserted being omitted.

Additionally, the machine has laterally of the spindle 18 a movable support or carriage 32, capable of longitudinally sliding on horizontal guide means 33 attached to the structure of the machine 10 (FIGS. 5, 6 and 7).

This support or carriage 32 can be moved longitudinally and relatively to said spindle 18 through a worm screw 34, such as a four-start worm screw, engaging with a nut made fast with said support 32.

The worm screw 34 is rotatably carried at intermediate position and beneath said guide means 33 and is keyed to a Geneva wheel 36 which, similarly to the first mentioned Geneva wheel, is driven to rotate through a fourth of revolution by a pin 37 carried sidewise projecting by a lever 38 made fast with a control shaft 39, the latter being connected to a second geared motor 40. Also in this case, the ratio of the mechanical members, particularly of the worm screw 34 to the associated nut should be such as to enable said support or carriage 32 to forwardly move by a predetermined distance corresponding to the constant pitch between two adjoining holes in each row of holes in said cylinder 19.

The carriage 32 carries both the device for pins insertion in cylinder 19 and the device for supplying said pins.

Particularly, the carriage 32 (FIG. 6) carries a pin feeding means comprising, in the case being considered, a trough 41 for receiving a substantial bulk amount of pins or pegs 21. This trough 41 is carried to rotate about a vertical axis and is maintained in rotation by a geared motor 42 at such a speed that, due to the centrifugal force, said pins are cast against the peripheral wall of the trough in aligned relationship and supplied by an elevation track 43 to a flexible duct 44 provided by a spirally wound spring which, in turn, leads to a storage means 45, wherein the pins are aligned and arranged parallel to one another, being supplied by gravity along a sinuous path in front of the outlet aperture 49 of the device for inserting the individual pins in the cylinder holes, according to a sequence governed by the pattern reader 12, as above referred to.

The device for pin insertion in the jacquard cylinder 19 substantially comprises a reciprocating pusher member, which is substantially formed of a small cylinder 46 horizontally sliding in a corresponding guide cavity 47 transversely of said support or carriage 32. At one end thereof said small cylinder 46 has a pin 48 which, by passing through a suitable hole provided at the end of said cavity 47, is effective on the last pin, that is the lowermost pin in the row of prearranged pins in the storage means 45 for causing it to emerge through an opening 49, thus inserting it in a hole facing the jacquard cylinder 19.

At its other end, said small cylinder 46 is connected to a guide rod 50 having an adjustable helical spring 51 threaded thereon. The reciprocation for said pusher 46, 48 is provided by a cam drive. More particularly, a lever 52 is pivoted at 52' and by one arm thereof, moving along a slit in the movable support or carriage 32, engages within a corresponding notch 46' of the small cylinder 46, while carrying at its other end a roller 52'' capable of sliding or reading the profile of a cam 53 rotably driven and sliding along a splined shaft 54. As shown in FIG. 7, this shaft 54 is connected to the above mentioned shaft 39 controlled by motor 40. The cam 53 is supported by rolling bearings 56 and connected to a part or element 57 fast with said movable support or carriage 32.

From the foregoing, it will be appreciated that as the shaft 54 rotates, when the cam follower roller 51' of lever 52 is on the high portion of cam 53, the small cylinder 46 of the pusher member is fully retracted with the spring 51 at compression state, and when the cam follower roller 52'' is on the low portion of cam 53, the small cylinder 46 of the pusher member is forward urged with the needle 47 to insert or not a pin or peg 21, depending on the command as received by the above mentioned pattern reading device.

The full forward movement of the small cylinder 46 to insert a pin, or the stop of the latter for preventing a pin from being inserted in the jacquard cylinder 19, depending on the commands given by the pattern reading device, is enabled and inhibited, respectively, by a ratchet gear or stop lever 58, which is pivoted at 59 and capable of penetrating through a cranked end thereof through an aperture in the guide for the small cylinder 46 to come in front of the latter, stopping the forward movement thereof. The control for the stop lever 58 is provided by an electromagnet 60 suitably operated by the sequence of said pattern reading device 12.

As above mentioned, the spindle 18 when operative is at the horizontal position shown in FIG. 2. Therefore, to allow for an easier insertion and removal of the jacquard cylinders 19, said spindle 18 is overturnably supported at vertical position. Particularly, the spindle support 61 (FIG. 2) is overturnable about a horizontal axis at right angles to the spindle and coincident with the axis of rotation for the worm screw 26 controlling the rotation of the spindle. This vertical position of the spindle 18 is particularly useful for unthreading the jacquard cylinders 19, as substantially preventing the pins 21 from falling or coming out, such pins being generally loosely or not forcibly inserted in the holes 20 of said cylinder.

Similarly, in order to avoid any falling or exiting for the pins 21 at the bottom half of cylinder 19, when the latter is at horizontal position, the spindle support 61 is extended at the bottom with a semicylindrical or bent tile shaped portion 62. The free end of said bent tile portion 62 engages with a holding hook 63 (FIGS. 2 and 3) manually operable to block or release the spindle 18 at its horizontal position.

Figure 4:
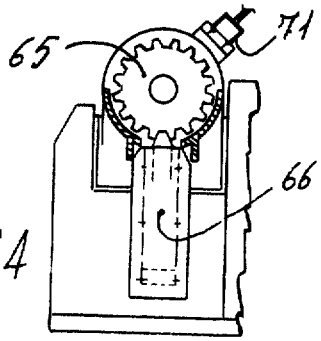
FIG. 4 is a detail view taken along line 4—4 of FIG. 2.

Further, as shown in FIGS. 2 and 4 of the appended drawings, in order to maintain said spindle 18 and hence said cylinder 19 correctly positioned with a hole row aligned with the pin outlet 49 from said inserting device, provision has been made for using a positioning device substantially comprising a gear 65 rotating with the spindle 18, with the end or tip of a rod or slider 66 vertically supported sliding in guides on the machine structure inserting between the teeth of said gear 65. This rod or slider 66 engages with a rocking lever 67 pivoted at 68 and acted upon by a control cam 69 which is keyed to the shaft 30 driven by the motor 31.

The cam 69 is operative to lower the lever 67 and thus release the positioning rod 66 from the teeth of said gear 65, while a spring 70 is effective in opposite direction to upward urge said positioner 66.

The operation of the machine for inserting pins in jacquard cylinders is substantially as follows. On pressing the holding hook 63, the spindle support 61 is released and can be accordingly rotated or overturned about the axis of the worm screw 26, vertically arranging said spindle to aid in introducing an empty jacquard cylinder.

Upon introduction of a jacquard cylinder 19, by bringing the reference pin 23 to coincide with a corresponding positioning notch in the spindle support, and after blocking the cylinder 19 on the spindle, through the rotation of handle 24 the assembly is restored to horizontal position with assurance of a correct hooking of hook 63. At this position, the positioning rod 66 will insert between two adjoining teeth of said positioning gear 65, assuring the correct position for the first row of holes in cylinder 19 relative to the outlet 49 for the pins 21 to be inserted. This correct positioning is further controlled by a cycle starting control device 71 (FIG. 4) comprising, for example, a microswitch or proximity contact, also providing to signal and stop the device after the last row of holes in cylinder 19 has been filled up.

After positioning the spindle 18 with a jacquard cylinder 19, and assume that the feeder 41 is running and the storage means 45 filled up with pins 21, the motor 40 will be operated, rotably driving the splined shaft 54 and thus the above described control cam 53.

The rotation of cam 53 will first cause the retraction of cylinder 46 and pin or peg insertion pin 47 and then a successive feeding for enabling or not the insertion of a pin in a corresponding hole in the cylinder depending on the controls as programmed by said pattern reader 12.

More particularly, a spoke insertion is controlled by said lever 52, which when reading the high profile of cam 53, will retract the small cylinder 46 and the pin 48 as well, enabling a lowermost pin 21 to fall from the sinuous storage means 45 and align with the outlet opening 49. Concurrently with the retraction of small cylinder 46, the spring 51 will be loaded, the force of this spring being adjustable by turning a ring nut 72, so that on arriving at the lowermost level of its travel, the cam 53 will allow the spring 51 to forwardly urge the small cylinder 46 and pin 48 for inserting a pin or peg in the jacquard cylinder 19. When required by the pattern, a peg or pin will be inhibited from insertion by the above mentioned lever 58, which is normally maintained at raised position by the electromagnet 60, but lowering to prevent the inserting device from forwardly moving, when required.

A proximity control 73 operated by the lever 51 will be effective to stop the machine should a pin become jammed in the storage means 45 and jacquard cylinder 19, or should it be missing, while enabling a next pin to be inserted when said control 63 suitably allows it and following correct insertion for the preceding pin.

When a pin has been inserted and on continued rotation of the drive shaft 39, the lever 38 and pin 37 will become effective causing the Geneva wheel 36 and hence the four-start screw 34 to rotate through one fourth of revolution at each revolution of shaft 39. Since the pitch of screw 37 corresponds to the pitch or spacing between two adjoining holes along each row of holes in the jacquard cylinder, the support or carriage 32 will move to position the hole inserting device in front of the successive next hole in the row.

The insertion or not of the pins in the holes of the preselected row, as well as the stepwise movement of the pin inserting device, will occur in accordance with the signals supplied by the pattern reader, as above mentioned.

Upon reaching the location of the last hole in a row, a contact 74 (FIG. 6) will correspond by a limit switch or microswitch 75 with other equivalent means, causing the motor 40 to be stopped and enabling the operations to be started for inserting pins in the adjoining row of holes, but in opposite direction to that of the preceding row. If desired, the whole pin inserting device could be brought back to the beginning at the other end of the jacquard cylinder, it being however apparent that the filling up in reverse direction of a subsequent row of holes will provide a considerable saving in time.

Therefore, a pulse from the microswitch 75 will start the geared motor 31 and rotate the lever 29, the latter causing by the pin 28 a rotation through one fourth of revolution for the Geneva wheel 27 and hence the worm screw 26 which, through the helical gear 25 will rotate the spindle 18 and hence the jacquard cylinder 19 to bring a second row of holes in alignment with the outlet opening 49 for the pins from the inserting device.

Similarly, at each rotation of the spindle drive shaft 30, a contact 76 will energize a limit switch or microswitch 77 (FIG. 7), enabling the shutdown of motor 31 and start of motor 40 and thereby allowing the operations to be started for inserting pins in the new row of holes in the jacquard cylinder. Of course, prior to any rotation of shaft 30 for the operation of said Geneva wheel 27, the positioning rod 66 should be disengaged from the gear 65, and then re-engaged after positioning.

The operation of the machine will continue until pin insertion in all of the hole rows in the jacquard cylinder is completed.

Upon completion of pin insertion in the jacquard cylinder, the machine will be stopped and the jacquard cylinder removed by upwardly vertically overturning it and releasing it by turning said handle 24, as above specified. Due to the vertical position of jacquard cylinder 19, any casual exiting of previously inserted pins will be avoided.

The jacquard cylinder will then be introduced into a proper container and stored or otherwise mounted on a circular knitting machine.

It should be noted that the matter above disclosed and shown in the appended drawings was given by mere way of exmple and that further changes could be adopted, for example as to the relative movement between the pin inserting device and the jacquard cylinder, and the work arrangement of the cylinder spindle and pin inserting device without departing for this from the scope of the invention.

I claim:

1. Apparatus for inserting pins in the holes of a needle selecting cylinder for a circular knitting machine which includes an electronic device having means for reading a pattern to be reproduced, said apparatus comprising a cylinder spindle having a spindle axis which is supported in a substantially horizontal position for horizontally supporting a needle selecting cylinder, means for rotating said cylinder spindle about said spindle axis, means for turning said spindle about a horizontal axis which is disposed perpendicular to said spindle axis, a support mechanism, means for moving said support mechanism in a direction substantially parallel to said spindle axis when said spindle axis is supported in said substantially horizontal position, a pin insertion mechanism carried by said support mechanism comprising a reciprocating pusher member and spring means for biasing said pusher member in a first direction, a control lever, a first portion of said control lever being connected to said pusher member, a second portion of said control lever including a cam follower, a control cam having a cam surface for engaging said cam follower, said control cam having a splined connection to a rotatably driven shaft and being connected to said support mechanism for movement therewith, said cam surface being operative on said cam follower and said control lever for allowing said pusher member to be driven in said first direction under the influence of said spring means and for thereafter driving said pusher member in a second direction against the bias of said spring means, means for feeding a pin into the path of said pusher as it is being driven in said first direction comprising means for supporting a plurality of pins in substantially parallel relationship and for permitting a pin to fall from said supporting means under the influence of gravity and into the path of said pusher, means for blocking movement of said pusher member in said second direction for disabling said pin insertion means, electromagnetic means for actuating said blocking means, a pin support extending beneath said needle selecting cylinder when said needle selecting cylinder is in a horizontal position for preventing inserted pins from falling from said needle selecting cylinder, said means for rotating said spindle, said means for moving said support mechanism and the means for controlling the movement of said pusher and said blocking means being controlled by signals from said electronic pattern reading device.

2. Apparatus as set forth in claim 1 wherein said means for rotating said spindle about its axis comprises a helical gear connected to said spindle, a worm gear engaging said helical gear, said worm gear being rotatable about an axis which is perpendicular to the axis of said helical gear, said turning axis being coincident with the axis of said worm gear.

3. Apparatus as set forth in claim 2 wherein the helical gear is connected to a Geneva wheel which is rotatably driven by an electrical motor.

4. Apparatus as set forth in claim 3 wherein said needle selecting cylinder includes a plurality of axially extending rows of holes, means for positioning said pin inserting means in alignment with a selected row of holes, said last mentioned means comprising a gear integral with said spindle, and a rod controlled by a cam and operative to engage with and disengage from said gear upon each operation of said Geneva wheel.

5. Apparatus as set forth in claim 1 wherein said means for moving said support mechanism comprises a worm gear, a nut integral with said support mechanism and engaging said worm gear, a second electrical motor connected to said worm gear for rotating said worm gear aroundd its axis, said electrical motor being connected to said worm gear by a second Geneva wheel.

6. Apparatus as set forth in claim 1 wherein the spring force of said spring is adjustable.

7. Apparatus as set forth in claim 1 wherein said pin feeding means is of the centrifugal type.

8. Apparatus as set forth in claim 1 further including means for disabling the operation of said pin insertion means if the pin is not correctly positioned or inserted in said needle selecting cylinder.

9. Apparatus as set forth in claim 1 wherein said needle selecting cylinder includes a plurality of axially extending rows of holes, said pin inserting means being operative to insert pins in a first one of said axially extending rows of holes during movement of said support mechanism in a first direction, and for inserting pins in an adjacent row of holes as said support mechanism is moving in a second direction which is opposite to said first direction.

* * * * *